US007422428B2

(12) United States Patent
Desmond

(10) Patent No.: US 7,422,428 B2
(45) Date of Patent: Sep. 9, 2008

(54) CANDLESTICK AND METHOD OF MAKING SAME

(75) Inventor: Gregory Desmond, Quincy, MA (US)

(73) Assignee: Gregory Desmond, Jr., Quincy, MA (US)

( * ) Notice: Subject to any disclaimer, the term of this patent is extended or adjusted under 35 U.S.C. 154(b) by 338 days.

(21) Appl. No.: 11/105,151

(22) Filed: Apr. 13, 2005

(65) Prior Publication Data

US 2005/0174761 A1 Aug. 11, 2005

Related U.S. Application Data

(63) Continuation-in-part of application No. 10/249,427, filed on Apr. 8, 2003, now abandoned.

(30) Foreign Application Priority Data

May 7, 2002 (RU) ..... 2002111750

(51) Int. Cl.
*F23D 3/16* (2006.01)
*F21L 19/00* (2006.01)

(52) U.S. Cl. ..... 431/289; 431/292; 431/297; 362/162; 362/161

(58) Field of Classification Search ..... 431/288, 431/289, 290, 291, 292, 293, 294, 295, 296, 431/299, 325; 362/161, 162
See application file for complete search history.

(56) References Cited

U.S. PATENT DOCUMENTS

2002/0162881 A1* 11/2002 Umanoff ..... 229/89

* cited by examiner

*Primary Examiner*—Alfred Basichas
(74) *Attorney, Agent, or Firm*—Cesari and McKenna, LLP

(57) ABSTRACT

A candlestick includes a tubular cartridge of biodegradable material having an upper end which forms a socket for a candle and a lower end, and a sleeve of flexible biodegradable material encircling the cartridge and extending appreciably above the upper end thereof. The sleeve is collapsible lengthwise towards the upper end of the cartridge so that when a candle is received the cartridge, the sleeve is gathered around the candle at the upper end of the cartridge forming a cuff or skirt which can catch any melted wax dripping from the candle. A method of making the candlestick is also disclosed.

6 Claims, 2 Drawing Sheets

CANDLESTICK AND METHOD OF MAKING SAME

RELATED APPLICATION

This application is a continuation-in-part of Ser. No. 10/249,427, filed Apr. 8, 2003 now abandoned, the entire contents of which are hereby incorporated herein by reference.

BACKGROUND OF THE INVENTION

This invention relates to a candleholder or candlestick. It relates more particularly to a holder for supporting a miniature candle, i.e. a birthday candle, upright in a cake or other confection.

The usual candlestick comprises a rigid member having a lower end shaped to form a stable base and an upper end defining a socket for holding a candle. Such candlesticks are designed to be placed on a stationary support surface such as a table or desk.

Candlesticks for supporting miniature candles on a cake or other confection usually include a cup-shaped plastic base defining a socket for receiving the lower end of the candle. The underside of the base is usually pointed enabling the candlestick be stuck into the top of a cake or other confection so that the candle is supported in an upright position. These prior candlesticks for birthday candles are not particularly convenient to use and they do not exclude the possibility of hot wax from a lit candle dripping onto the confection. Also, the prior candlesticks used for this purpose being made of plastic are not environmentally friendly.

Utility model RU No. 19309 discloses a candlestick of the general type with which we are concerned which has a full body, the upper part of which is widened to catch hot wax dripping from the candle. A candleholder is positioned inside the body and has a stepped form for accommodating candles having various diameters. Although this known candlestick catches dripping wax, it is made of plastic or other non-biodegradable material and is therefore not environmentally friendly. Moreover, that candlestick is difficult to place on a cake or other confection.

SUMMARY OF THE INVENTION

Accordingly it is an object of the present invention to provide an improved candlestick for supporting a small candle.

Another object of the invention is to provide a candlestick of this type which is disposable and therefore environmentally friendly.

A further object of the invention is to provide such a candlestick which is easy to make and convenient to use.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, my candlestick comprises a relatively stiff, tubular, biodegradable cartridge and a sheet of highly flexible biodegradable sheet material snugly encircling the cartridge so that its edges overlap thereby forming a tube. Preferably, the lower end of the tube is even with the lower end of the cartridge and the tube is appreciably longer than the cartridge so that the tube extends well beyond the cartridge. Preferably also, the inside diameter of the cartridge is the same as or only slightly larger than the diameter of a typical birthday candle so that it forms a ring or socket for snugly receiving a lower end segment of the candle.

In use, a candle is inserted into the upper end of the tube until the lower end of the candle is plugged into the upper end of the cartridge. Then, the segment of the tube extending above the cartridge is slid down toward the cartridge so that it is gathered around the candle at the upper end of the cartridge thereby forming a larger diameter cuff or skirt around the base of the candle which can catch any melted wax running down the candle when the candle is lit.

The lower end of the cartridge may be pinched together to facilitate staking the cartridge in a cake or other confection so that the candle is supported in an upright position thereon.

BRIEF DESCRIPTION OF THE DRAWINGS

For a fuller understanding of the nature and objects of the invention, reference should be made to the following detailed description taken in connection with the accompanying drawings, in which.

DETAILED DESCRIPTION OF ILLUSTRATIVE EMBODIMENTS

Figure 1:
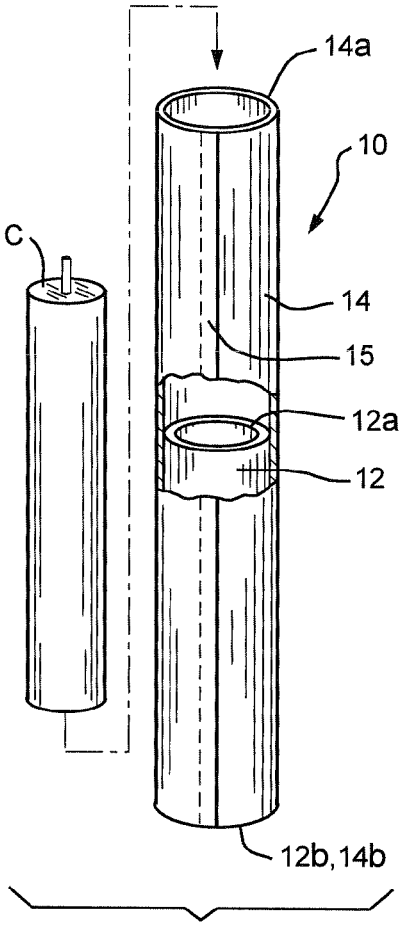
FIG. 1 is a perspective view with parts broken away illustrating a candlestick incorporating the invention for supporting a candle.

Referring to FIG. 1 of the drawings, my candlestick comprises a tubular, open-ended cartridge 12 having an upper end 12*a* and a lower end 12*b*. Preferably, cartridge 12 is formed of a stiff paper or cardboard. The inside diameter of cartridge 12 is more or less the same of that of a standard candle C of a type commonly placed on birthday cakes or other confections. Thus the upper end 12*a* of cartridge 12 forms a socket or ring for snugly engaging around the base of candle C so that the candle extends up vertically from cartridge 12.

Snugly encircling cartridge 12 is a tubular sleeve 14 of very flexible sheet material such as tissue paper, cigarette paper, thin parchment or the like. A sheet of that material may be engaged around cartridge 12 with the edges of that sheet overlapping and being secured together along a seam 15 as shown in FIG. 1. The fit of the tube around the cartridge is tight enough to prevent relative movement of those two parts. Preferably sleeve 14 is appreciably longer than cartridge 12 so that its upper end 14*a* extends well above the upper end 12*a* of cartridge 12 when the lower ends 12*b*, 14*b* of the cartridge and sleeve are even as shown. Preferably, the sleeve is about twice as long as the cartridge.

Figure 2:
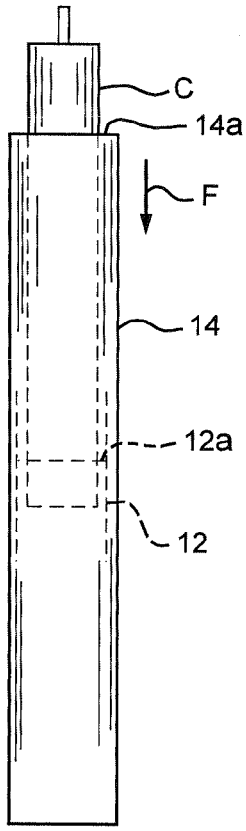
FIG. 2 is an elevational view showing the candlestick actually supporting the candle and with the candlestick's sleeve in an extended position.

In use, the candle C is coupled to the candlestick 10 by inserting the lower end of the candle into sleeve 14 until that lower end plugs into the upper end 12*a* of cartridge 12 so that the candle is an extension of the cartridge as shown in FIG. 2.

Figure 3:
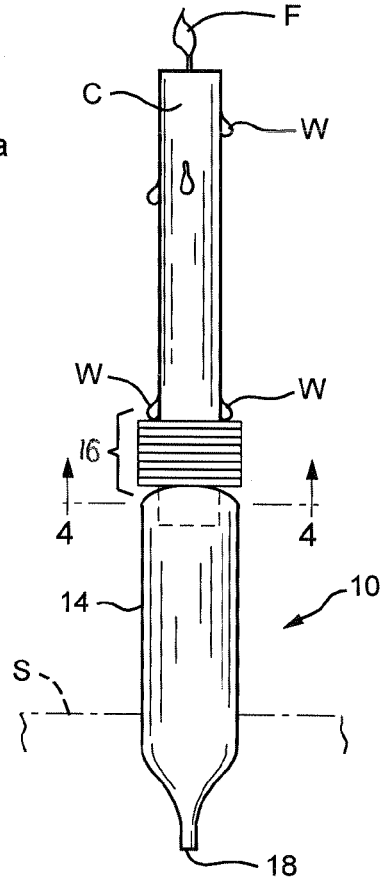
FIG. 3 is a similar view of the candlestick showing its sleeve in a collapsed position.
Figure 4:
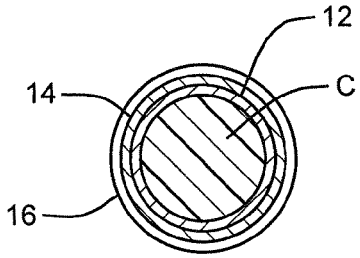
FIG. 4 is a sectional view taken along line 4-4 of FIG. 3.

Then, a downward force F is applied to the upper end 14*a* of sleeve 14 as shown in FIG. 2 which causes that segment of the sleeve to slide down around the candle and become gathered around the candle at the upper end of cartridge 12 thereby forming an enlarged cuff or skirt 16 which extends all around the candle as best seen in FIGS. 3 and 4. The material of sleeve 14 is flexible and extensible enough to enable the formation of the radially enlarged corrugations or wrinkles that form the cuff or skirt 16. Thus, when the candle is lit forming a flame F which melts the top of the candle, any hot wax W running down or dripping from the candle is intercepted by the cuff or skirt 16 at a location above cartridge 12.

As shown in FIG. 3 the lower end 12*b*, 14*b* of the candlestick may be pinched to from an edge or point 18 so that that end may easily penetrate the surface S of a confection such as a cake, scoop of ice cream or the like.

Figure 5:
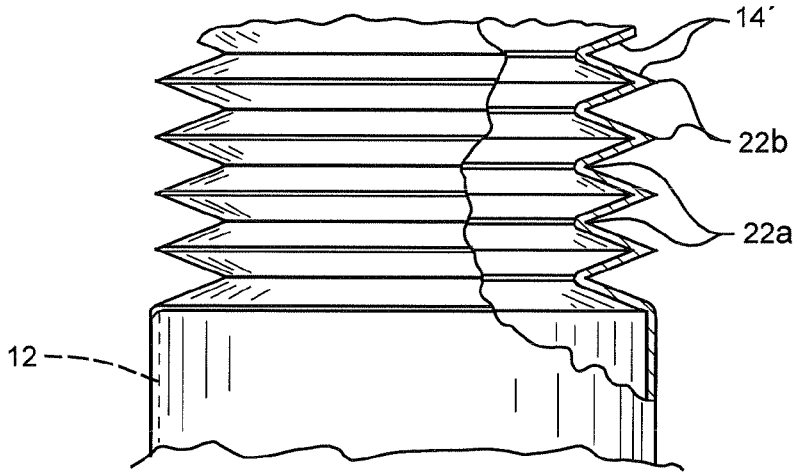
FIG. 5 is a fragmentary elevational view with parts broken away, on a much larger scale, illustrating another collapsible sleeve embodiment for the FIG. 1 candlestick.

If desired, the sleeve 14 may be formed with circumferential corrugations or score or fold lines to facilitate the collapsing of the tube in bellows-like fashion to form the cuff or skirt 16. FIG. 5 illustrates such a sleeve 14' having in and out fold lines 22*a* and 22*b*.

Figure 6A:
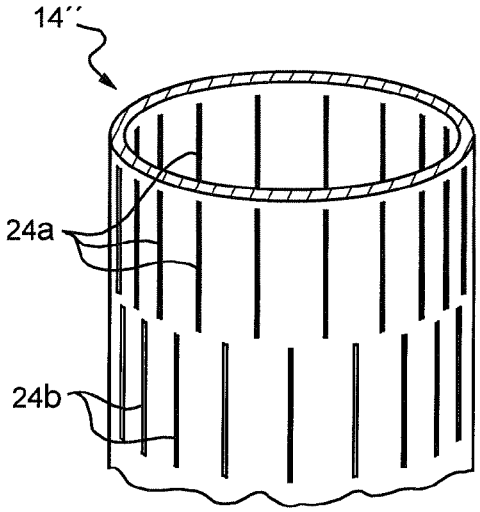
FIGS. 6A and 6B are a fragmentary side elevational view with parts in section and a top plan view of yet another collapsible sleeve embodiment showing the sleeve in its extended and collapsed positions, respectively.
Figure 6B:
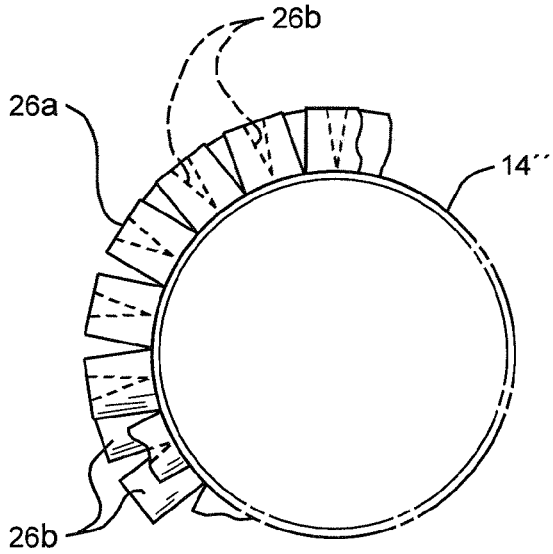

Also, to provide a larger diameter cuff or skirt 16, the sleeve may be slitted lengthwise. FIGS. 6A and 6B show a sleeve 14" having two sets of slits 24*a* and 24*b* which are offset circumferentially. When the sleeve is collapsed, the material between the slits bows out to form two sets of tabs 26*a* and 26*b* which are offset so as to form a substantially continuous skirt around the base of the candle.

Since the cartridge 12 and sleeve 14 are both made of paper or similar biodegradable material, the candlestick will not persist and is therefore environmentally friendly. Also, being composed of simple parts which may be made using conventional tube making machinery, the candlestick is easy and inexpensive to manufacture. By the same token, it is quite easy to use and therefore should prove to be a very marketable item.

It will thus be seen that the objects set forth above among those made apparent from the preceding description are efficiently attained. Also, since certain changes may be made in carrying out the above method and in the constructions set forth without departing from the scope of the invention, it is intended that all matter contained in the above description as shown in the accompanying drawings be interpreted as illustrative and not in a limiting sense.

It is also to be understood that the following claims are intended to cover all of the generic and specific features of the invention described herein.

What is claimed is:

1. A candlestick comprising a tubular cartridge of biodegradable material having an upper end which forms a socket or ring for a candle and a lower end, and a sleeve of flexible biodegradable material encircling the cartridge and extending appreciably above the upper end thereof, said sleeve being collapsible lengthwise towards said upper end of the cartridge so that when a candle is received in the cartridge, the sleeve may be gathered around the candle adjacent the upper end of the cartridge to form a radially enlarged cuff or skirt which can catch any melted wax dripping from the candle, said lower end of the cartridge and the sleeve therearound being pinched to form an edge or point to facilitate inserting the candlestick into a confection.

2. A method of making a candlestick comprising the steps of forming a tubular cartridge having open upper and lower ends;

encircling the cartridge with a sheet of flexible material to form a sleeve having an upper end that lies appreciably above the upper end of the cartridge;

inserting the lower end of a candle into the upper end of the cartridge so that the cartridge supports the candle in an upright position within the sleeve, and collapsing the upper end of the sleeve toward the upper end of the cartridge so that the sleeve is gathered around the candle adjacent the upper end of the cartridge forming a radially enlarged cuff or skirt which can intercept any hot wax dripping from the candle.

3. The method defined in claim 2 including the step of forming the sleeve to be about twice as long as the cartridge.

4. The method defined in claim 2 including the additional step of pinching the lower end of the cartridge and the sleeve therearound to form an edge or point so that the lower end of the cartridge can easily penetrate the surface of a confection.

5. The method defined in claim 2 including the step of forming the sleeve with circumferential fold lines to facilitate the collapse thereof.

6. The method defined in claim 2 including the step of slitting the sleeve lengthwise to facilitate the collapse thereof.

* * * * *